US006847168B1

(12) United States Patent
Ives et al.

(10) Patent No.: US 6,847,168 B1
(45) Date of Patent: Jan. 25, 2005

(54) ELECTRON GUN FOR A MULTIPLE BEAM KLYSTRON USING MAGNETIC FOCUSING WITH A MAGNETIC FIELD CORRECTOR

(75) Inventors: R. Lawrence Ives, Saratoga, CA (US); George Miram, Atherton, CA (US)

(73) Assignee: Calabazas Creek Research, Inc., Saratoga, CA (US)

( * ) Notice: Subject to any disclaimer, the term of this patent is extended or adjusted under 35 U.S.C. 154(b) by 48 days.

(21) Appl. No.: 09/629,364

(22) Filed: Aug. 1, 2000

(51) Int. Cl.[7] ..... H01J 23/087; H01J 25/10
(52) U.S. Cl. ..... 315/5.14; 315/5.16; 315/5.35
(58) Field of Search ..... 315/5.14, 5.16, 315/5.35

(56) References Cited

U.S. PATENT DOCUMENTS 3,293,563 A * 12/1966 Nevins, Jr. ..... 315/5.16 X
4,137,482 A 1/1979 Caryotakis
4,508,992 A 4/1985 Bohlen
4,555,646 A * 11/1985 Miram et al. ..... 315/5.35
4,733,131 A * 3/1988 Tran et al. ..... 315/5.14
5,032,763 A * 7/1991 Mourier ..... 315/5.14 X
5,113,162 A * 5/1992 Umehara et al. ..... 315/5.35 X
5,932,972 A 8/1999 Symons

FOREIGN PATENT DOCUMENTS

WO WO 97/38436 10/1997

* cited by examiner

*Primary Examiner*—Benny T. Lee
(74) *Attorney, Agent, or Firm*—Jay A. Chesavage

(57) ABSTRACT

An RF device comprising a plurality of drift tubes, each drift tube having a plurality of gaps defining resonant cavities, is immersed in an axial magnetic field. RF energy is introduced at an input RF port at one of these resonant cavities and collected at an output RF port at a different RF cavity. A plurality of electron beams passes through these drift tubes, and each electron beam has an individual magnetic shaping applied which enables confined beam transport through the drift tubes.

32 Claims, 10 Drawing Sheets

Brillouin Focused

Confined Flow
Prior Art

141

Section A-A

ELECTRON GUN FOR A MULTIPLE BEAM KLYSTRON USING MAGNETIC FOCUSING WITH A MAGNETIC FIELD CORRECTOR

FIELD OF THE INVENTION

The present invention relates to linear beam electron devices, and more particularly, to an electron gun that provides multiple convergent electron beamlets suitable for use in a multiple beam klystron using confined flow magnetic focusing.

BACKGROUND OF THE INVENTION

Linear beam electron devices are used in sophisticated communication and radar systems that require amplification of a radio frequency (RF) or microwave electromagnetic signal. A conventional klystron is an example of a linear beam electron device used as a microwave amplifier. In a klystron, an electron beam is formed by applying a voltage potential between a cathode emitting electrons and an anode accelerating these emitted electrons such that the cathode is at a more negative voltage with respect to the anode. The electrons originating at the cathode of an electron gun are thereafter caused to propagate through a drift tube, also called a beam tunnel, comprising an equipotential surface, thereby eliminating the accelerating force of the applied DC voltage. The drift tube includes a number of gaps that define resonant cavities of the klystron. The electron beam is velocity modulated by an RF input signal introduced into the first resonant cavity. The velocity modulation of the electron beam results in electron bunching due to electrons that have had their velocity increased gradually overtaking those that have been slowed. Velocity modulation in the gain section of the tube leads to bunching, i.e. the transformation of the electron beam from continuously flowing charges to discrete clumps of charges moving at the velocity imparted by the beam voltage. The beam bunches arrive at the bunching cavity, sometimes called the penultimate cavity, where they induce a fairly high RF potential. This potential acts back on the beam, and serves to tighten the bunch. When the bunches arrive at the output cavity they encounter an even higher rf potential, comparable to the beam voltage, which decelerates them and causes them to give up their kinetic energy. This is converted to electromagnetic energy and is conducted to a load. The tighter the bunching, the higher the efficiency. However, a high degree of space charge concentration interferes with the bunching process and the efficiency. Other things being equal, the higher the perveance of a klystron, the lower the efficiency.

The effect of perveance on the gain of a klystron is different. Although the gain is affected by space charge, it is a stronger function of the total current, which is proportional to the perveance. This suggest that if a beam cross-section were made larger, so that the current density and space charge are reduced, both gain and efficiency would benefit. However, such is not the case because a large beam requires a large drift tube, and the electric fields which couple the beam to the circuit fall off across the beam, leading to poor coupling and a drop in both gain and efficiency. A small beam is therefore necessary, but if the power output required is high, the voltage, rather than the current in the beam must be increased for reasonable efficiency.

Bandwidth is inversely proportional to the loaded Qs of the klystron cavities. In the gain section of the tube, where cavities are stagger-tuned, the cavity Qs are loaded by the beam. The higher the current, the higher the loading, and consequently the lower the Q. It does not matter if a single beam or several beams are traversing the cavity. The output cavity, in particular, must by itself have a bandwidth at least equal to the desired bandwidth of the klystron. For the output cavity to produce good efficiency, this bandwidth becomes proportional to the beam conductance. However this leads to higher perveances, and hence lower efficiency. Consequently, in a single beam klystron the efficiency/bandwidth product is approximately constant.

Given the preceding relationships, the advantage of the multiple beam klystron provides is clear. The current is divided into several beams, each with a low space charge, so that it can be bunched tightly in a small drift tube with good coupling coefficient, and hence high efficiency. The gain-bandwidth product is not constant, but increases with the addition of beams. For the same power and gain, the multiple beam klystron is shorter than a conventional klystron.

Despite the potential advantages of multiple beam klystrons, such devices have only been adapted for certain low power or low frequency applications in which a convergent electron beam is not necessary. In these nonconvergent devices, electron beam focusing is provided by immersing the electron gun and drift tubes in a strong magnetic field which guides the electrons along the magnetic flux lines to the drift tubes. In a nonconvergent electron gun, the diameter of the emitting surface is the same as the electron beam that propagates through the RF device. The nonconvergent electron beams of this class of device have limited current density, which prevent them from developing more power at higher frequencies. The amount of current that can be emitted from the cathode is dependent on the size of the emitting surface and the maximum electron emission density that can be provided by the surface. Maximum electron emission densities from typical cathodes operating in the space charge limited regime are on the order of 10–20 amps/cm^2.

In a convergent electron gun, the cathode diameter exceeds the diameter of the final electron beam, which means that more current can be provided. The current gain is proportional to the area compression factor of the gun, which is the ratio of the cathode area to the cross sectional area of the final electron beam. Typical compression factors are 5–20.

Electron beams used for linear RF devices typically employ one of two types of magnetic focusing, which act in addition to the initial electrostatic focusing of a Pierce electron gun, whereby a stream of emitted electrons is initially focused to a region of minimum beam diameter. The first type of magnetic focusing is Brillouin focusing, where the magnitude of the magnetic field in the circuit section of the device precisely balances the space charge repulsion forces within the static beam. An embodiment of such a device is shown in FIG. 1. Electrostatic focusing is used to guide the electron beam from the cathode emitting surface to a point within the anode beam tunnel. A minimum diameter is achieved, and if a counteracting magnetic field were not applied, the beam would begin to diverge due to space charge forces. In Brillouin magnetically focused devices, an axial magnetic field is imposed at the location of the minimum diameter that balances the space charge forces and facilitates transport of the beam through the device.

Unfortunately, the balance between the space charge force tending to expand the beam and the magnetic force tending to confine the beam is no longer equal when electrostatic bunching of electrons occurs, as is required to transform beam power into RF power. Consequently, the beam will expand in regions of high electron density, eventually resulting in impact of electrons with the walls of the beam tunnel. This can result in destruction of the device unless the power deposited is limited. Therefore, Brillouin focused devices are limited in the average RF power and pulse lengths that can be generated.

The alternative is to use convergent, confined flow focusing, as shown in FIG. 2. With confined flow focusing, the magnetic field encompasses the cathode regions of the device where the electron beam is generated. A combination of magnetic and electrostatic focusing is used to guide the electron beam from the cathode into the beam tunnel. With confined flow focusing, the magnetic field can be higher than is required for balancing the space charge forces in the static beam. In typical devices, the magnetic field is 2–3 times the Brillouin value. With confined flow focusing, the convergent electron beam will be contained as it traverses the beam tunnel, even in the presence of electron bunching as used to generate RF power. Consequently, confined flow focused devices are capable of high average power operation.

In typical single beam devices, the magnetic field is generated from a solenoid or permanent magnet symmetrically located with respect to the electron beam, which produces a magnetic field that is radially symmetric about the electron beam, which is typically located on the main axis of the device. This radially symmetric field is necessary for the electron beam to follow its non-divergent axial path. The magnitude and shape of the field in the cathode-anode region is controlled using an iron enclosure around the main solenoid or permanent magnet with an aperture through end plates perpendicular to the device axis, allowing field penetration into the cathode-anode region. Auxiliary coils or permanent magnets may also be used in the cathode-anode region to control the shape and magnitude of the field.

While this works well for single beam devices having a beam tunnel symmetrically located with respect to the magnetic field axis, problems occur for electron guns where the cathode-anode region is radially displaced from the device axis. A radial gradient, or shear, in the magnetic field in the cathode-anode region distorts the magnetic focusing, preventing operation of the device. In order to realize a multiple beam device, it is necessary for most cathode-anode structures to be radially displaced from the device axis.

In light of these limitations, the need for a high power, multiple beam klystrons with confined flow focusing for use with high frequency RF sources is clear.

RELATED ART

A device described by Symons [U.S. Pat. No. 5,932,972] provides for a convergent multiple beam gun having a single cathode, a first plurality of conductive grids, a second plurality of drift tubes further containing resonant gaps, and an anode. The first plurality of conductive grids are spaced between the cathode and drift tubes, and contain apertures in locations such that electron beamlets are formed and defined by electrons traveling from the cathode, through the apertures in each of the grids, and into the drift tubes. Each of the grids has these apertures in substantial registration with each other and with respective openings of the plurality of drift tubes.

Symons relies on a plurality of grids to shape the electric potentials to focus the individual beamlets into the respective drift tunnels. In one embodiment of the invention, four separate grids are required to provide the necessary electric field configuration. Ceramic insulators providing a portion of the vacuum envelope of the device must electrically isolate each grid. In addition, a separate voltage is required for each grid.

The device described by Symons does not provide for confined flow focusing, as it can be seen that no magnetic focusing field is applied, and beam focusing is performed entirely by electrostatic potentials applied to the many grids. Consequently, the beam will not be fully confined in the presence of space charge bunching, limiting the average and peak power capability of the device. Further, the device described by Symons applies only to fundamental mode cavities, which limits the frequency at which this technique can be applied.

As the RF frequency increases, the available space for multiple beams through a fundamental mode cavity decreases in proportion to the increase in frequency. Consequently, the number of beams that can propagate through a fundamental mode cavity becomes limited by mechanical and thermal constraints. An alternative is to use a ring resonator circuit as described by Bohlen (U.S. Pat. No. 4,508,992). With a ring resonator circuit, the number of beamlets is not strictly limited by frequency considerations. Bohlen describes a microwave amplifier having an annular cathode, an annular ring resonator for the introduction of RF energy, an annular ring resonator for the removal of RF energy, and an annular collector, all of which are operating in the presence of a magnetic field. This structure enables reduced current densities and the application and collection of RF energy over a large physical area. A disadvantage of this structure is that the annular beam tunnels can allow transmission of higher order cavity modes back toward the electron gun. These modes can lead to undesired bunching of the electron beam and prevent operation at the desired frequency and power. Consequently, the gain of this device is limited to less than 25, and the output power level is limited to a few megawatts.

A multiple beam device using periodic permanent magnet focusing was described by Caryotakis et al (European patent WO 97/38436). This device uses periodic permanent magnet (ppm) focusing. PPM focusing uses an array of permanent magnets with alternating magnetic orientations to produce a focusing magnetic field. The focusing field produced by PPM focusing is axial, as in solenoidal focusing, but alternates direction, unlike solenoidal focusing. PPM focusing has been used for years for beam focusing in traveling wave tubes. The focusing described by Caryotakis only applies to beam confinement within the body or circuit section of the device and is not applicable to the electron gun region. Further it requires a series of cylindrical permanent magnets around each individual beam tunnel. Since these magnets can not tolerate high temperatures, they must be applied after construction of the vacuum envelope of the rf device. High power operation of rf devices requires processing in ovens operated at 400–500 degrees C. in order to obtain sufficient vacuum for operation. Consequently, each beam tunnel must contain its own individual vacuum envelope to provide access for the PPM magnets.

Since the device proposed by Caryotakis does not address the magnetic focusing in the electron gun, the present invention could be adapted to work in conjunction with the device described by Caryotakis.

SUMMARY OF THE INVENTION

In view of the limitations of the prior art, the present invention provides for an RF device having convergent multiple beams for use in high frequency, high power RF generators, such as multiple beam klystrons or inductive output tubes (IOT). This device has a plurality of drift tubes for the transport of multiple convergent beamlets in a rectilinear flow. Each drift tube carries an electron beam formed by an individual electron gun, and a plurality of these electron guns is arranged in a circular ring, with each electron gun providing a beam for use by an associated drift tube. Each electron gun has a cathode, an electrostatic focusing electrode and anode structure. The path of the confined flow of electrons from each electron gun through the drift tubes of the device forms a beam tunnel, and each separate gun has its own separate beam tunnel. Gaps between drift tubes form resonant cavities for the introduction and removal of RF power and for increased bunching of the electron beam. The RF power introduced into an input port of the device operates on each individual beamlet traveling through each individual beam tunnel, and RF power extracted at the output port is summed by the RF output structure. In the context of the present device, a high power composite electron beam is formed which comprises the contribution of each individual beamlet, so the output power of the device is limited only by the number of beamlets that are contributing to the RF output port. While the beamlets formed by each electron gun travel through separate beam tunnels, the anode structure and cathode structure for each gun may be separate, or it may be shared.

In one embodiment of the invention, the beam tunnels for each electron beam include drift tubes having a first resonant cavity defined by a first gap provided in the plurality of drift tubes, and a second resonant cavity defined by a second gap provided in the plurality of drift tubes. An electromagnetic signal is coupled into an RF input port to the first resonant cavity, which velocity modulates the beamlets traveling in the plurality of drift tubes. The velocity modulated beamlets then induce an electromagnetic signal into the second resonant cavity, which may then be extracted from the device RF output port as a high power microwave signal. Other resonant cavities may also be applied between the first and final resonant cavity to increase the gain, bandwidth and efficieny of the device. A collector is disposed at respective ends of the plurality of drift tubes, which collects the remaining energy of the beamlets after passing across the various cavities. A magnetic field oriented coaxially to the beam tunnel is furnished to provide confined flow of the electron beam.

OBJECTS OF THE INVENTION

A first object of the invention is a multiple beam device for the amplification of Rf power having a plurality of electron beam tunnels, each said tunnel carrying an electron beam formed by an electron gun. The multiple beam device consists of the following elements:

- a plurality of drift tubes, the drift tubes separated to form a plurality of gaps associated with resonant cavities, including a first gap for the introduction of RF energy through an RF input port, and a final gap for the removal of RF energy through an RF output port,
- an anode for the acceleration of electrons,
- a magnetic field generator producing a radially symmetric field along a common axis defined by the beam tunnels,
- and a plurality of magnetic field correctors for producing a magnetic field which is radially symmetric through each individual beam tunnel.

A second object of the invention is a multiple beam device having a plurality n of electron guns, each electron gun providing an electron beam traveling through an electron beam tunnel between a cathode and a beam collector, a common magnetic field applied to the beams of all n electron guns, individual magnetic field correctors applied to each individual gun, an RF input port, and an RF output port.

A third object of the invention is a multiple beam device having an input RF port and an output RF port common to all electron beamlets.

BRIEF DESCRIPTION OF THE DRAWINGS

FIG. 4-1, detail shows the detail of a beam tunnel having drift tubes and resonant gaps.

FIGS. 4*a*, 4*b*, and 4*c* are sections a—a, b—b, and c—c, respectively, through FIG. 4.

DETAILED DESCRIPTION OF THE INVENTION

Figure 1:
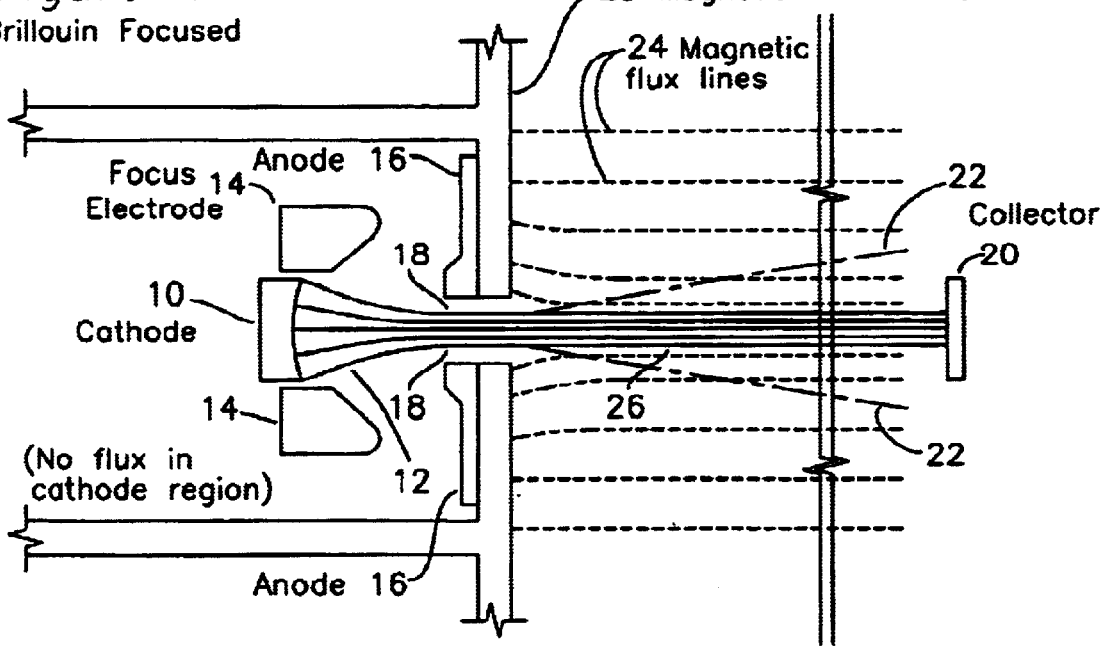
Figure 1 Prior Art
FIG. 1 is a schematic of a prior art Brillouin focused electron gun.

FIG. 1 shows a prior art Brillouin focused electron gun. A cathode 10 provides a flow of electrons 12 past an anode 16 at a positive voltage with respect to the cathode to a distant collector 20. In a Pierce gun, focus electrode 14 shapes the electron beam to a region of minimum beam diameter 18. Without a magnetic field, the self-charge of the electron beam causes beam spreading due to the space charge effect as shown in the trajectory 22. In Brillouin focusing, a magnetic field 24 is added which is coaxial to the beam 12, and of sufficient magnitude to cancel the space charge spreading, which results in the constant width beam 26, as shown. This magnetic field 24 may be provided through the introduction of electromagnetic coils or permanent magnet material and magnetic pole piece 28.

Figure 2:
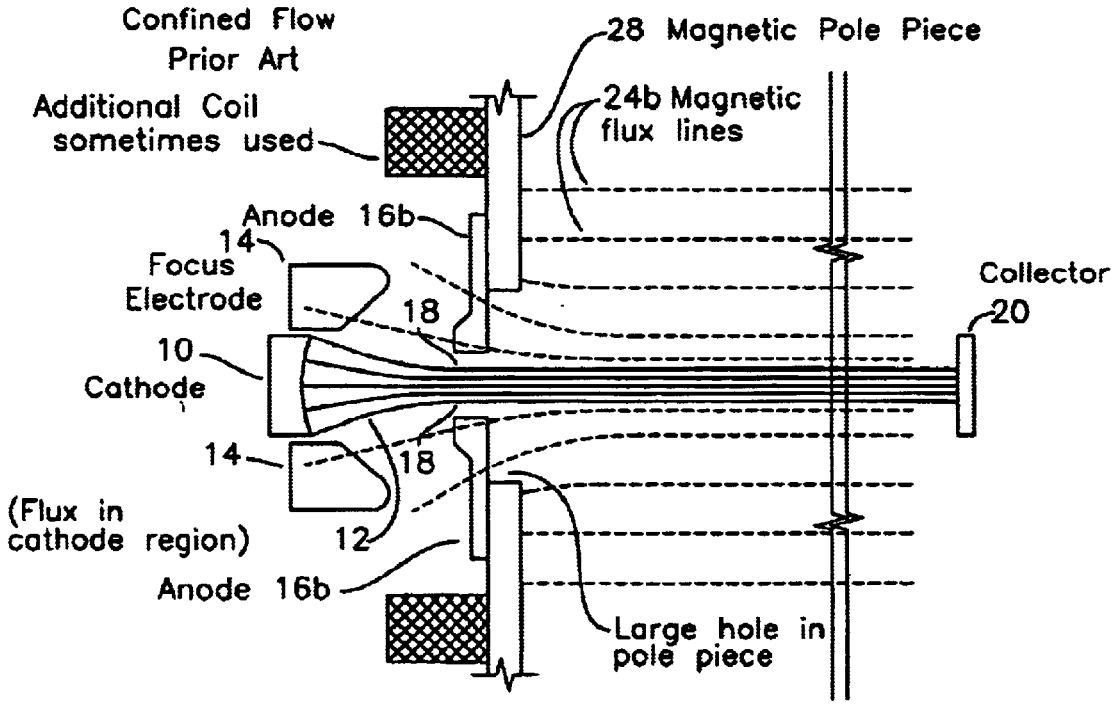
FIG. 2 is a schematic of a prior art confined flow electron gun.

FIG. 2 shows a prior art confined flow electron gun. As before, a Pierce gun comprising cathode 10 and focus electrode 14 produces an electron beam 12, which converges to a region of minimum diameter 18, after passing anode 16*b*. The coaxial magnetic flux field 24*b* is provided that is allowed to pass through the polepiece 28 and extend to the cathode, which provides a confined flow of electrons to the distant collector 20. The extension of the magnetic flux field to the cathode allows for an increase in the magnetic field greater than that necessary for precisely balancing the space charge forces in the unbunched beam.

Figure 3:
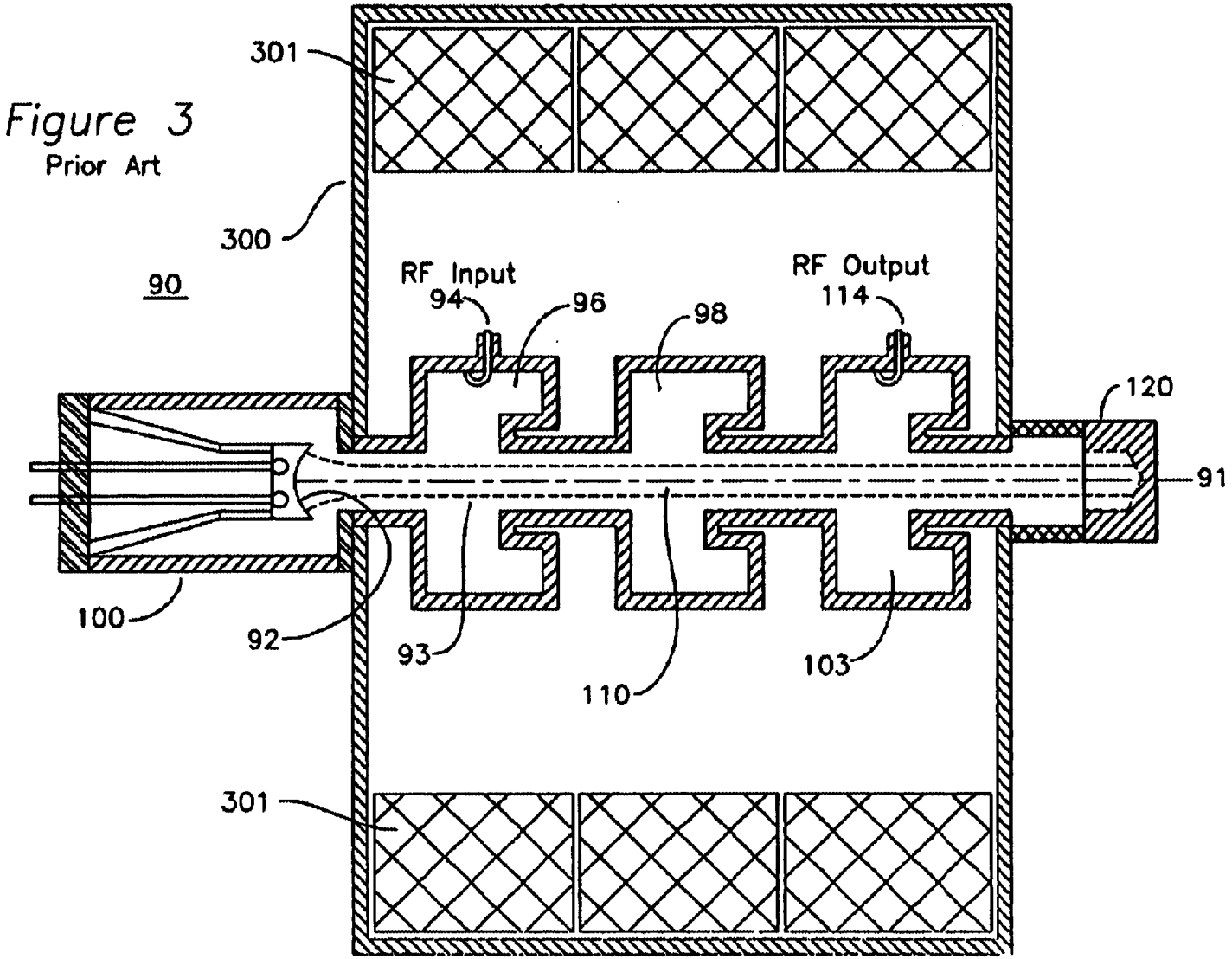
Figure 3 Prior Art
FIG. 3 is a section view of a prior art single beam klystron with a magnetic circuit.

FIG. 3 shows a prior art single beam klystron tube 90. Electron gun 100 provides a beam of initially focused electrons 92, which travel through a beam tunnel 93 to collector 120. The beam tunnel 93 is enclosed by electromagnet 301, which produces a coaxial magnetic flux field with flux lines parallel to the beam axis 91 and beam tunnel 93 within the iron enclosure 300. An RF input port 94 couples incoming RF energy to a resonant cavity 96, which velocity modulates the beam 110. A second resonant cavity 98 provides additional modulation, and a third cavity 103 enables the removal of RF energy through RF output port 114.

Figure 4:
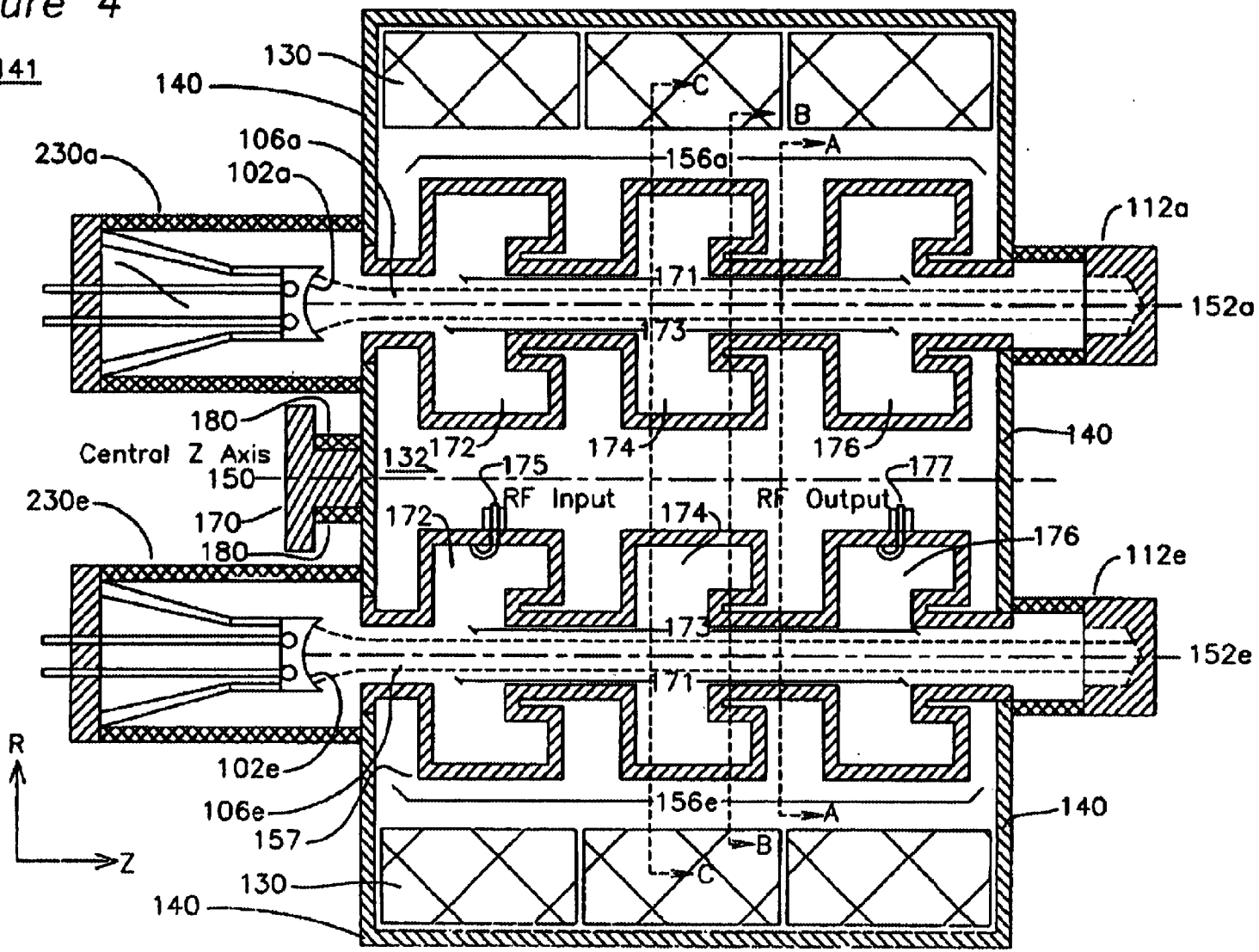
FIG. 4 is a section view of a multiple beam klystron showing individual electron guns creating a multiplicity of beamlets. Also shown is the magnetic circuit for focusing of the individual convergent multiple beams.
Figures 1, 4:
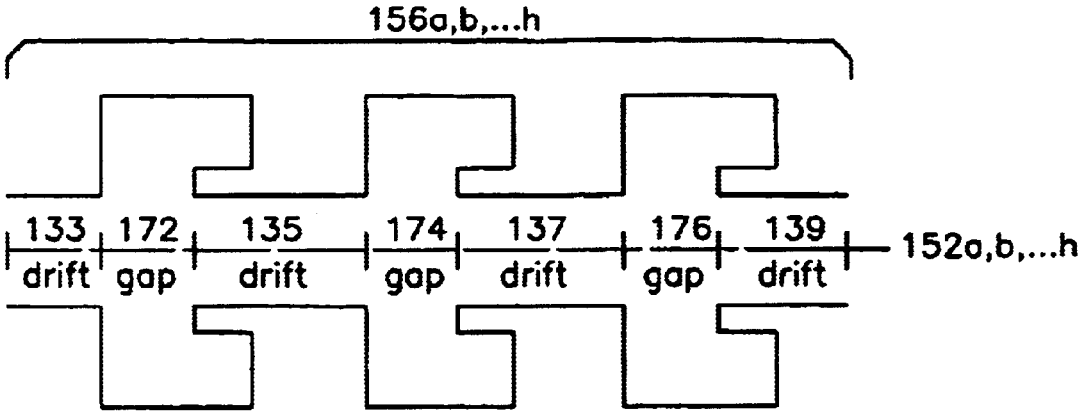

FIG. 4 shows the present invention, which provides a convergent multiple beam klystron 141 having a plurality of high current electron beams to permit construction of a multiple beam RF device of high power and high frequency. While the development of symmetric fields for radially symmetric devices is simplified by the intrinsic symmetry of the magnetic structures, this is not the case for multiple gun, off-axis designs such as the present invention of FIG. 4. As known in the art, conventional electron guns are designed using advanced computational tools to model the electrostatic potential, magnet flux contours, and electron trajectories. Examples of these codes include Maxwell 2D® and Beam Optics Analysis (BOA®) from Ansoft Corporation, the three dimensional finite difference program MAFIA®, and the beam trajectory code XGUN®. These tools were used to model the present invention to insure that laminar electrons beams were generated suitable for a klystron or IOT RF circuit. It is clear to one skilled in the art that magnetic field design tools of this type are required for the optimization of specific structures for use in shaping a magnetic field in the present art of designing confining flow magnetic fields for use in electron beam devices. For the present invention, Maxwell 2D® and MAFIA® were used to design a magnetic configuration where lines of magnetic flux intersect each cathode perpendicular to the emitting surface with sufficient magnitude to guide the electrons through the cathode-anode region into the center of each beamlet's respective beam tunnel. Maxwell 2D® was also used to design the electrostatic geometry providing equipotential contours consistent with the desired operation. BOA® and XGUN® were used to model electron trajectories through the cathode-anode region to insure that the desired performance was achieved.

Figure 4A:
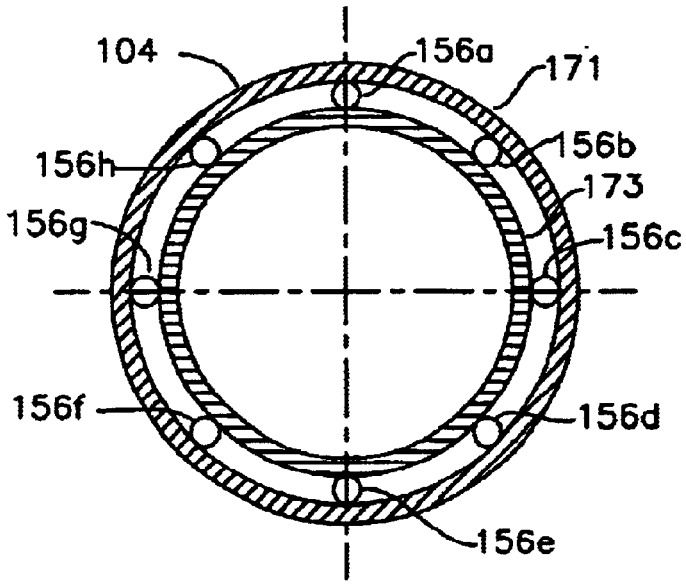

FIGS. 4*a*, 4*b*, and 4*c* show cross section views of the present invention, and may be examined in conjunction with corresponding sections a—a, b—b, and c—c of FIG. 4. A plurality n of electron guns, illustrated for the case n=8 and shown as 230*a*, 230*b*, . . . 230*h* is arranged circularly around a central axis Z 150. A reference plane R is perpendicular to the axis Z 150, and is used in the illustrations for section a—a, b—b, and c—c. FIGS. 4*a*–4*c* show a cross section view of a device. Each electron gun 230*a* . . . *h* is arranged circularly around the central axis Z and produces a beamlet which initially focuses to a minimum diameter 106*a* . . . *h* as described earlier in FIG. 2. As is clear to one skilled in the art, other non-circular and irregular inter-gun spacings can be used, but the regular spacings and circular arrangement is shown for clarity in the drawings. Each beamlet from each electron gun 230*a* . . . *h* travels through its own beam tunnel 156*a* . . . *h* along a beam tunnel axis 152*a* . . . *h* to a collector 112*a* . . . *h*. Each beamlet travels in its respective beam tunnel axis 152*a* . . . *h* which has a conductive inner surface 173, and the beam tunnel comprises drift tubes 133, 135, 137, and 139, and a series of resonant cavities 172, 174, 176 formed by drift tube gaps along each beam tunnel axis 152*a* . . . *h* and beam tunnel 156*a* . . . *h*, and shown in FIG. 4-1 detail. These cavities are for the introduction of RF power, additional modulation of the electron beamlets, and the extraction of RF power, as before. The coaxial magnetic flux field generator 130 (shown in FIG. 4) comprises a coil wound around the axis 150, which produces a generally uniform flux field 132 (shown in FIG. 4) aligned with the central axis 150, as before. The resonators are shown as 172, 174, 176 comprise the annular ring resonators described, for example, in U.S. Pat. No. 4,508,992 by Bohlen et al (items 1 and 2), incorporated herein by reference. A key feature of the embodiment shown in FIG. 4 is the presence of an iron structure 170 and electromagnetic coil or permanent magnet 180, located along the centerline of the device and positioned at the approximate location of the individual cathodes 102. The iron structure 170 and magnet 180 provide compensation for the radial asymmetry of the magnetic field at the location of the individual cathodes 102*a* . . . *h* (cathodes 102*a* and 102*e* only are visible in FIG. 4 section view), as will be described later.

FIGS. 4*a*–4*c* shows the sections a—a, b—b, and c—c, respectively, which include beam tunnels 156*a* . . . *n*, and the inner surface 173 and outer surface 171 of resonators 174.

Figure 5:
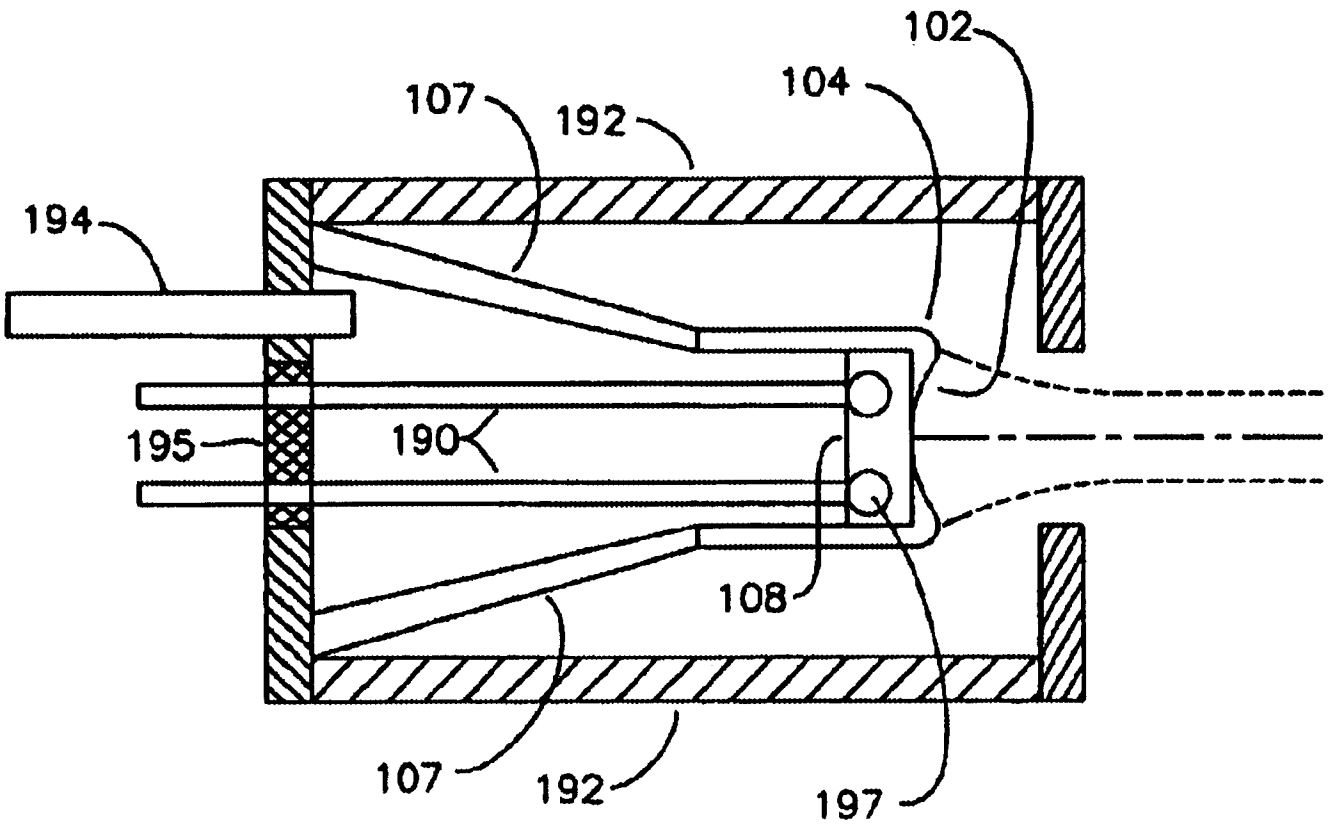
Figure 5 Prior Art
FIG. 5 is a section view of the electron gun shown in FIG. 4.

FIG. 5 shows the key elements of the individual electron guns which include the emitting surface 102, focus electrode 104, cathode heater 197, heat shields 108, insulating ceramic 192, vacuum pumpout 194, and insulating ceramic 195 for the heater wire feedthrough 190. Supports 107 anchor the cathode 102 in the electron gun of FIG. 5.

In the present invention as described in FIGS. 6 through 10, magnetic circuits are disclosed which provide for individual focusing of each beamlet to insure optimum beam transport through the RF device. The magnetic circuits include a series of electromagnet coils or permanent magnets that provide the magnetic field and appropriately placed magnetic iron structures to shape the field as required by each beamlet. In particular, magnetic iron is incorporated near each individual cathode to bend the magnetic field lines so that they are everywhere perpendicular to the emitting surface as required for laminar electron flow. Magnetic iron is incorporated around the main magnet coils or permanent magnets to provide for proper flux leakage into the cathode-anode region and to guide the electron beamlets through the circuit of the RF device.

For some high frequency and high power applications it may be convenient to employ a klystron using ring resonator cavities. Ring resonator cavities allow for location of the electron beamlets at a larger radius from the device axis than is possible with simple fundamental mode cavities.

Figure 6A:
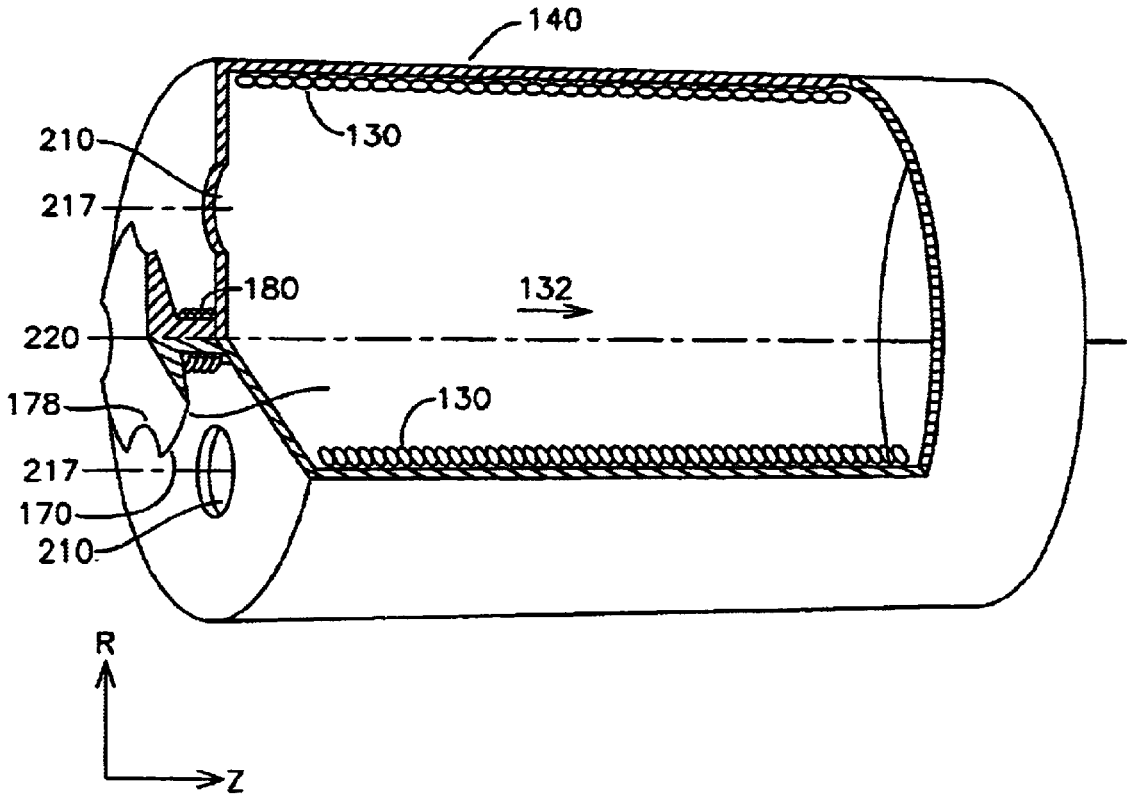
FIG. 6*a* is a three dimensional view of the magnetic circuit of FIG. 4 showing an electromagnetic coil and shaped iron structure in the gun region for reducing radial and azimuthal asymmetries at the cathode locations.

An embodiment of the magnetic circuit for the device of FIG. 4 is shown in FIG. 6*a*. A shell of magnetic iron 140 encloses magnetic coils 130 that generate the main magnetic field 132 for the RF device. As is clear to one skilled in the art, it would be possible to substitute a self-magnetic structure such as a permanent magnet for the coil 130 with appropriate modifications to iron structure 140. Apertures 210 are placed in the end walls of the shell 140 to allow passage of the electron beamlets 106*a* . . . *h* (shown in FIG. 4) and to allow magnetic flux to extend into the cathode-anode regions 101 (not shown) of the electron guns 230 (not shown) to aid in beam focusing. An auxiliary electromagnet coil or permanent magnet 180 is located along the device centerline 220 and between the centerline and the individual electron guns 230. In addition magnetic material 170 is located along the device centerline 220 and between the electron guns 230 and the centerline 220. The magnetic material (i.e. iron) 170 may include semicircular extensions 178 extending partially around the centerline of each individual beamlet 217 to reduce azimuthal asymmetries in the magnetic field at the location of the individual cathodes 102 (shown in FIG. 4).

Figure 6B:
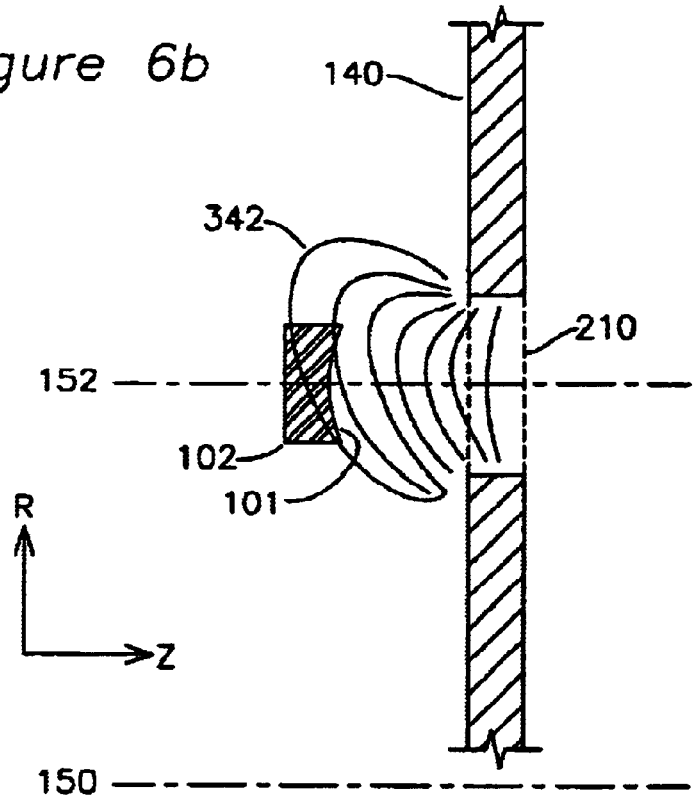
FIG. 6*b* is the cross section of the uncorrected magnetic field and the envelope of the electron beam produced by an uncorrected off-axis electron beam of FIG. 6*a*.

FIG. 6*b* shows a section in the RZ coordinate system in the region between the magnetic polepiece end plate 140 and the electron gun emitter 102 where no correction is made to the magnetic field using coil 180 (not shown) or magnetic structure 170 (not shown). The figure plots contours of constant magnetic field 342 emanating through aperture 210 and extending to cathode 102. Certain structures from FIG. 6*b* are shown on FIG. 6*c* for clarity, including electron gun cathode 102 with electron emitting surface 101, shell 140, and beam tunnel axis 152. Note the asymmetry about the cathode centerline 152 and the variation of magnetic field across the emitting surface 101 of the cathode 102. Electrons emitted perpendicular to surface 101 will experience a magnetic field in which the direction of the magnetic field vector is different from the direction of electron motion, thereby imparting a transverse force on the electron that will prevent proper transmission through the RF device.

Figure 6C:
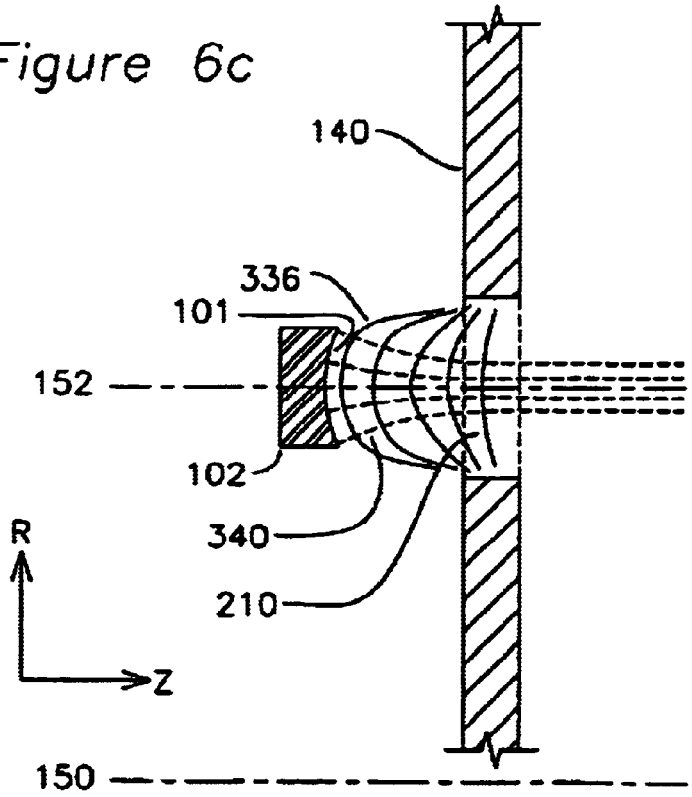
FIG. 6*c* is the cross section of the corrected magnetic field and the envelope of the electron beam produced by the configuration of FIG. 6*a*.

FIG. 6*c* shows equipotential magnetic flux lines in the vicinity of the electron beam aperture 210 with auxiliary coil 180 (shown in the magnetic circuits of FIGS. 4, 6*a*, 7, and 9) and magnetic material 170 (shown in the magnetic circuit of FIGS. 4, 6*a*, 7, and 9). It can be seen that the equipotential magnetic flux lines 336 and the electron beam paths 340 are perpendicular. Thus the direction of electron motion from the emitting surface 101 of the cathode 102 is parallel to the magnetic force direction, eliminating magnetically induced forces perpendicular to the direction of electron motion, which causes the electron beam entering aperture 210 to experience confined flow with no trajectory divergence or beam spreading. The emitting surface 101 is thermionically emitting electrons towards the aperture 210 due to heating of the cathode 102 and the accelerating presence of an anode (not shown), as was described in prior art FIG. 2. Shell 140 and beam beam tunnel axis 152 were described in FIG. 4.

Figure 7:
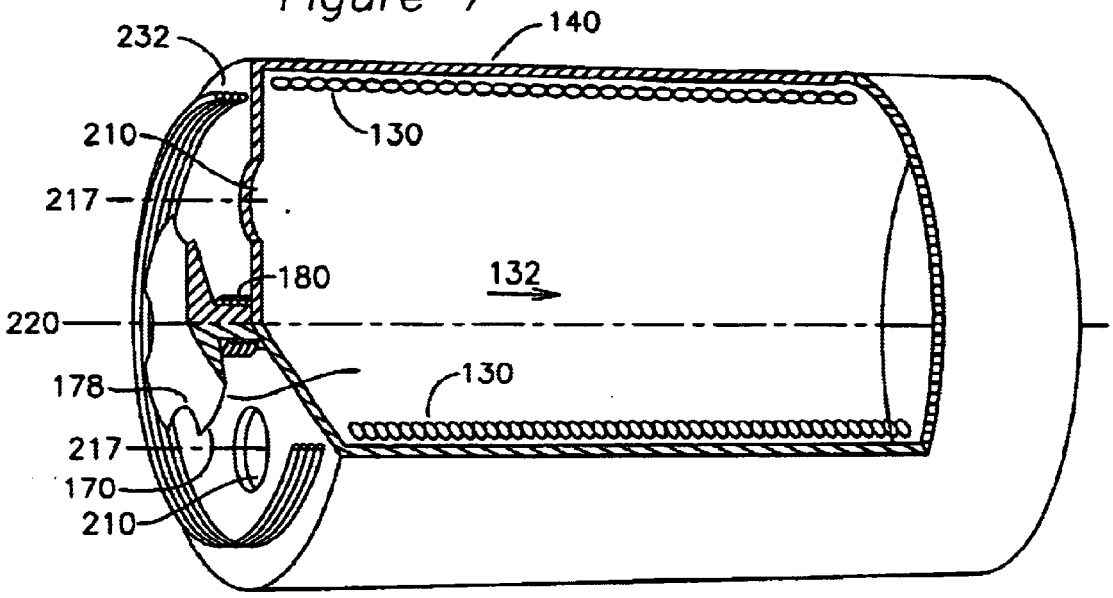
FIG. 7 is an alternate embodiment of the configuration of FIG. 6*a* with an auxiliary electromagnet or permanent magnet surrounding the plurality of cathodes.
Figure 8:
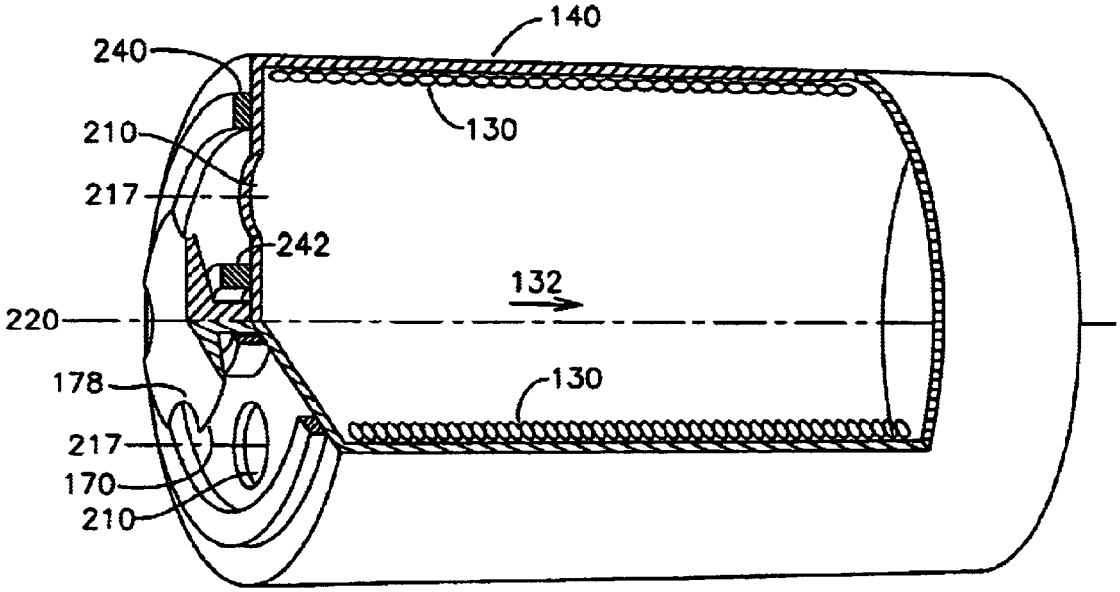
FIG. 8 is an alternate embodiment of the configuration of FIG. 6*a* with an auxiliary permanent magnets surrounding the plurality of cathodes and a permanent magnet interior to the plurality of cathodes.

An alternate embodiment is shown in FIG. 7, where an additional field shaping electromagnet coil 232 is located about the centerline of the device 220 but at a distance from the centerline so as to surround the cathodes for the individual beamlets. Certain structures from FIG. 6*a* are shown in FIG. 7 for clarity including Auxiliary coil 180, shell 140, coil 130, apertures 210, beamlets 217, iron structure 170, main magnetic field 132, and cutout 178. As is clear to one skilled in the art, and shown in FIG. 8, permanent magnets 240 and 242 could be substituted for coils 232 and 180 of FIG. 7 with no change in function. Field shaping electromagnet 232, or 180 or shaping magnet 240 or 242 would equivalently allow additional control of the magnetic field in the region of the electron beamlets. An alternate embodiment would include an iron shield partially enclosing coil 232 on the outer circumference and end to limit flux leakage into the environment and reduce the power required for electromagnetic coils or the field strength for permanent magnets. Certain structures from FIG. 6*a* are shown in FIG. 8 for clarity including shell 140, coil 130, apertures 210, beamlets 217, main magnetic field 132, iron structure 170, central axis 220, and cutout 178. As is clear to one skilled in the art, there are many combinations of electromagnets or permanent magnets which could be used to satisfy the condition of creating a magnetic field which is perpendicular in gradient to the electron beam trajectory over all operating regions of the device.

Figure 9:
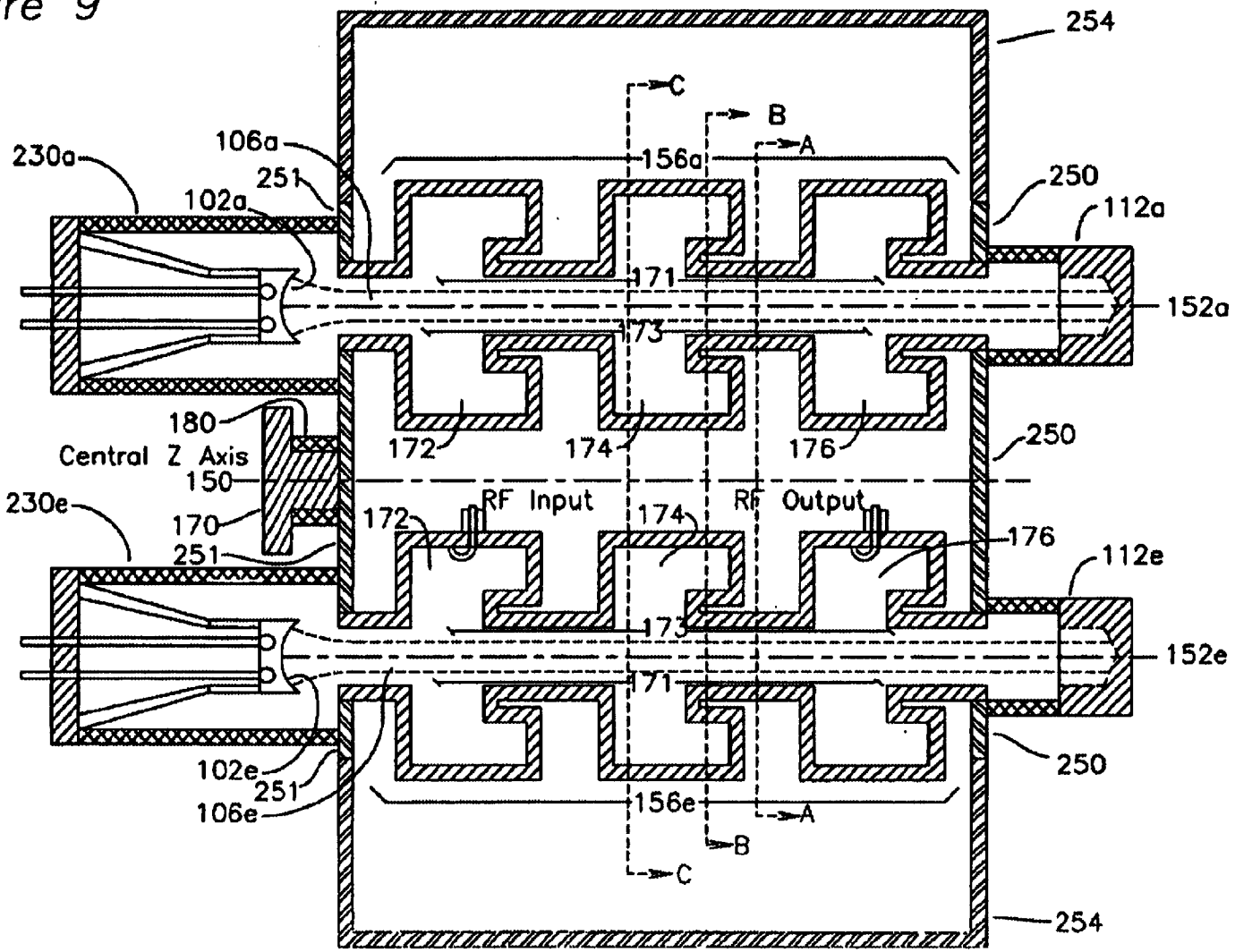
FIG. 9 is the device of FIG. 4 where permanent magnets are used in place of electromagnets.

FIG. 9 shows the device of FIG. 4 wherein the iron materials 140 (shown on FIG. 4) and magnetic coils 130 (shown in FIG. 4) are replaced by iron materials 250, 251, and permanent magnet 254, respectively. Certain structures from FIG. 4 are shown in FIG. 9 for clarity including electron guns 230*a* and 230*e*; beamlet focusing to minimum diameter 106*a* and 106*e*, central axis 150, iron structure 170, thermionic emitting surface 102*a* and 102*e*, resonators 172, 174, and 176, cathode centerline 152*a* and 152*e*; electron collector 112*a* and 112*e*; inner surface 173; magnet 180; beam tunnels 156*a* and 156*e*; and outer surface 171.

Figure 10:
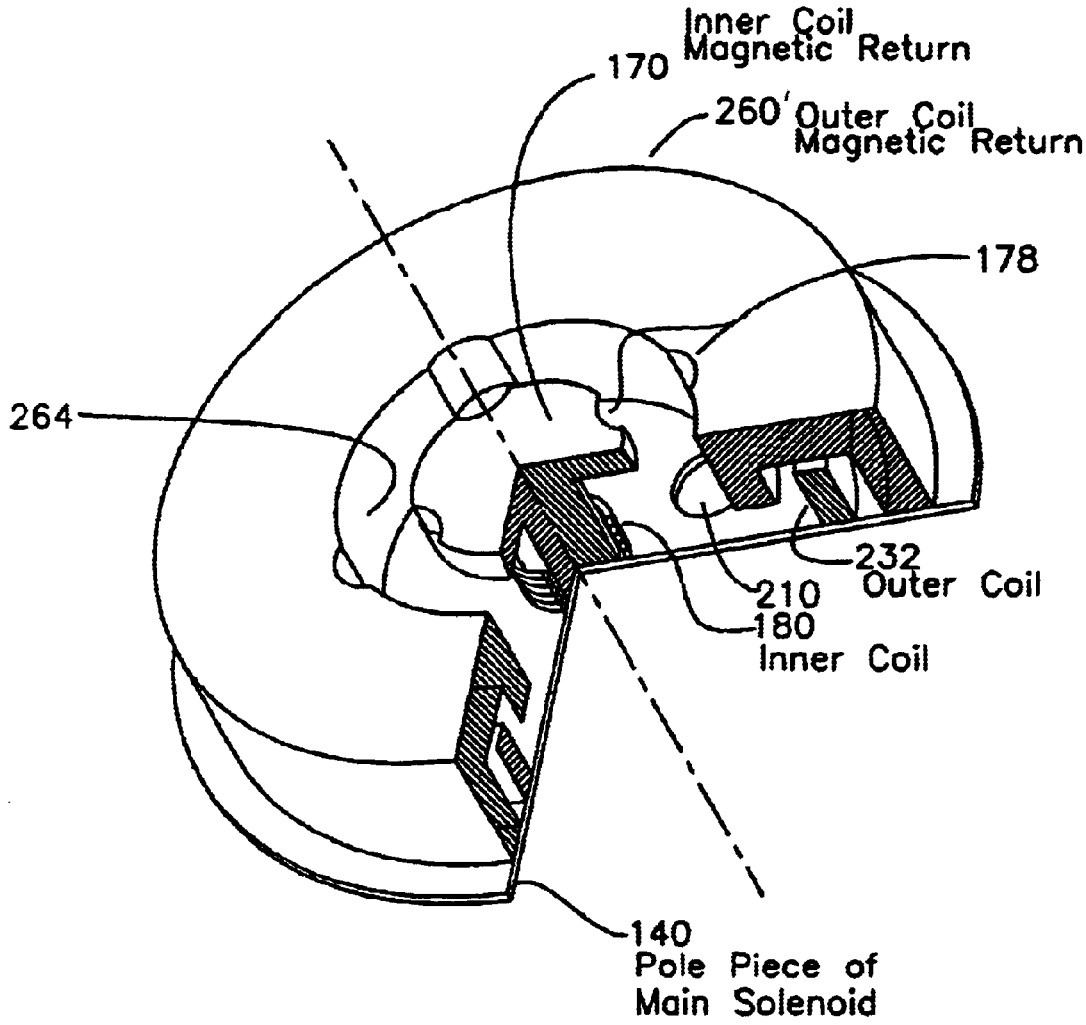
FIG. 10 is the device of FIG. 4 including additional magnetic material surrounding the plurality of cathodes to provide additional field correction.

FIG. 10 shows an alternate embodiment of the multiple beam device where additional magnetic material 260 is incorporated at a larger radius than the electron guns 230 (not shown) whose electron beams 106 (not shown) pass through apertures 210 and interior to outer magnetic coil 232 (shown in FIG. 7) or permanent magnet 240 (shown in FIG. 8). The magnetic material may contain specially shaped surfaces 264 to further correct the magnetic field for radial or azimuthal asymmetries in cooperation with coils 232 and 180 and interior magnetic structure 170. Cutouts 178 are present in iron 170 and magnetic material 260 adjacent to shell 140.

As shown in the alternative embodiments, the design conditions which produce a magnetic field for the confined flow of a plurality of radially positioned electron beams are numerous. Many alternative structures could be proposed which satisfy this condition, and the structures given are proposed only for illustration in understanding the present invention. The present RF device may operate as an amplifier, or as an oscillator, or in any way a single beam prior art device may operate. As vehicles for understanding the present invention, it is not intended that the scope of the invention is limited to only the structures shown. The breadth of the invention is established by the following claims.

What is claimed is:

1. A multiple beam RF device comprising:

a housing having a central Z axis, said housing enclosing a plurality of electron beam tunnels, each said beam tunnel having a conductive inner surface, and each said beam tunnel further comprising a sequence of drift tubes and drift tube gaps, said beam tunnels arranged about said central Z axis of said housing, and said housing including a plurality of apertures, one said aperture for each said electron beam tunnel;

a plurality of electron guns equal to said plurality of said electron beam tunnels, each said electron gun producing an electron beam passing uniquely through a respective one of said electron beam tunnels;

a magnetic field applied to each said electron beam, said magnetic field having a variation of less than 5% over the extent of said electron beam tunnels;

each said electron gun having a respective cathode for the generation of electrons, a respective anode for the acceleration of said electrons, and a respective focus electrode for the focusing of said electron beams;

a magnetic field corrector adjacent to each said electron gun cathode for correcting said magnetic field such that said cathode surface has a magnetic field which is everywhere perpendicular to each said cathode surface.

2. The RF device of claim 1 wherein said plurality of beam tunnels are arranged substantially parallel to said central Z axis.

3. The RF device of claim 2 wherein at least one of said drift tube gaps includes a port for the introduction of RF energy, and at least one of said drift tube gaps includes a port for the removal of RF energy.

4. The RF device of claim 3 wherein said housing is made from iron.

5. The RF device of claim 1 wherein said magnetic field is sufficient to achieve confined electron flow.

6. The RF device of claim 1 wherein said magnetic field produces a confining force which exceeds the space charge forces in each said electron beam.

7. The RF device of claim 6 where the magnitude of said magnetic field is at least 2 times greater than said magnetic field required to balance said space charge force.

8. A multiple beam RF device comprising:

a housing having a central Z axis and an R plane orthogonal to said Z axis, said housing enclosing a plurality of electron beam tunnels, each said beam tunnel having a conductive inner surface, and each said beam tunnel further comprising a sequence of drift tubes and drift tube gaps, said beam tunnels arranged in said housing and parallel to said central axis Z of said housing, said drift tubes having a minimum separation distance from said central axis Z of value D;

a plurality of electron guns, each said electron gun having a respective cathode with a thermionic emitting surface for the generation of electrons, a respective anode for the acceleration of said electrons, and a respective focus electrode for the focusing of said electrons into an electron beam, each said electron beam passing through a corresponding one of said electron beam tunnels;

a magnetic field applied to each said electron beam, said magnetic field having a field variation of less than 5% over the extent of said electron beam tunnels;

one or more magnetic field correctors located adjacent to said cathode and between said plurality of electron guns and an electron beam entrance to a corresponding said beam tunnel, said one or more magnetic field correctors modifying said magnetic field such that said magnetic field is perpendicular to each said respective cathode emitting surface.

9. The RF device of claim 8 wherein said one or more magnetic field correctors comprises a single coil located near at least one said electron gun cathode, and said extent of said single coil is less than said separation distance D.

10. The RF device of claim 8 wherein said one or more field correctors comprises a single coil located near at least one said electron gun cathode and said extent of said coil is greater than said separation distance D.

11. The RF device of claim 9 or 10 wherein said coil comprises a single coil of current-carrying wire which produces said correction field.

12. The RF device of claim 8 wherein said one or more field corrector comprises a coil of current-carrying wire which produces said correction field.

13. The RF device of claim 8 wherein said one or more field corrector comprises a permanent magnet.

14. The RF device of claim 8 wherein said one or more field corrector comprises non-magnetized iron.

15. The RF device of claim 8 wherein said one or more field correctors comprises a first coil with an extent less than said separation distance D, and a second coil with an extent greater than said separation distance D, said first coil and said second coil located adjacent at least one said electron gun cathode.

16. The RF device of claim 15 wherein said second coil comprises a coil of current-carrying wire which produces said correction field.

17. The RF device of claim 15 wherein said first coil comprises a coil of current-carrying wire which produces said correction field.

18. The RF device of claim 8, wherein said one or more field correctors is located on the central axis of said device, said one or more field corrector has a near end in proximity to said housing and intersecting said central Z axis, and a far end opposite said near end, said one or more field corrector comprising a radially symmetric magnetic cylinder, said one or more field corrector having a first radius on said near end, and a second radius on said far end which is larger than said first radius.

19. The RF device of claim 18, said one or more field correctors further including an electromagnetic coil on said first radius.

20. The RF device of claim 18 or 19, said one or more field correctors further including field correcting cutouts around said plurality of electron guns.

21. The RF device of claim 8 wherein said one or more field correctors provides a magnetic field such that equipotential flux lines formed by said magnetic field when modified by said one or more field corrector are substantially parallel to said electron beam tunnels.

22. The RF device of claim 1 or 8 wherein said RF device is an amplifier.

23. The RF device of claim 1 or 8 wherein said RF device is an oscillator.

24. A magnetic circuit for influencing the trajectories of a plurality of electron beams, said magnetic circuit comprising:

a cylindrical enclosure having a central axis and a first end cap having a plurality of apertures for the introduction of a plurality of electron beams and a second end cap for the removal of said electron beams, each said beam starting from a respective thermionic cathode;

a main field generator producing a magnetic field perpendicular to said central axis;

a circularly symmetric flange located on said central axis, said flange having a small diameter part for the disposition of a magnetic field generator and a large diameter part for introducing said field proximal to at least one of said cathodes.

25. A magnetic circuit for influencing the trajectories of a plurality of electron beams, said magnetic circuit comprising:

a cylindrical enclosure having a central axis and a first end cap having a plurality of apertures for the introduction of a plurality of electron beams and a second end cap for the removal of said electron beams, each said beam starting from a respective thermionic cathode;

a main field generator producing a magnetic field perpendicular to said central axis;

a circularly symmetric flange located on said central axis, said flange having a small diameter part for the disposition of a magnetic field generator and a large diameter part for introducing said field proximal to at least one of said cathodes;

additional magnetic field correctors influencing said magnetic field adjacent to said respective cathodes, said magnetic field correctors located in an extent starting from said first end cap and extending in a direction opposite said second end cap.

26. The magnetic field generator of claim 25 where said main field generator is an electromagnetic coil.

27. The magnetic field generator of claim 25 where said main field generator is a permanent magnet.

28. The magnetic circuit of claim 25 where said magnetic field generator is a coil wound about said small diameter part.

29. The magnetic circuit of claim 25 where said magnetic field generator is a circular permanent magnet.

30. The magnetic circuit of claim 25 where said additional magnetic field correctors includes a supplemental circular field generator located on the outer surface of said first end cap, having a center on said central axis, and having a diameter sufficient to enclose said apertures on said first end cap inside said diameter of said supplemental field generator.

31. The magnetic field generator of claim 30 where said supplemental field generator is an electromagnetic coil.

32. The magnetic field generator of claim 30 where said supplemental field generator is a permanent magnet.

* * * * *

UNITED STATES PATENT AND TRADEMARK OFFICE

CERTIFICATE OF CORRECTION

PATENT NO. : 6,847,168 B1
DATED : January 25, 2005
INVENTOR(S) : Ives, Miram

It is certified that error appears in the above-identified patent and that said Letters Patent is hereby corrected as shown below:

Column 1,
Line 4, add the sentence: -- This invention was made with Government support under Contract No. DE-FG03-00ER82964 awarded by the Department of Energy. The Government has certain rights in this invention. --

Signed and Sealed this

Fifth Day of July, 2005

JON W. DUDAS
*Director of the United States Patent and Trademark Office*